US005633671A

United States Patent [19]

Watanabe

[11] Patent Number: 5,633,671

[45] Date of Patent: May 27, 1997

[54] RECORDING METHOD AND APPARATUS MAINTAINING CONSTANT DENSITY BY ANTICIPATING TEMPERATURE CHANGES IN THE RECORDING HEAD

[75] Inventor: Youichi Watanabe, Machida, Japan

[73] Assignee: Canon Kabushiki Kaisha, Tokyo, Japan

[21] Appl. No.: 582,013

[22] Filed: Jan. 2, 1996

Related U.S. Application Data

[63] Continuation of Ser. No. 240,213, May 9, 1994, abandoned, which is a continuation of Ser. No. 3,956, Jan. 19, 1993, abandoned, which is a continuation of Ser. No. 632,644, Dec. 26, 1990, abandoned, which is a continuation of Ser. No. 420,018, Oct. 11, 1989, abandoned.

[30] Foreign Application Priority Data

Oct. 13, 1988 [JP] Japan ..... 63-255937
Sep. 28, 1989 [JP] Japan ..... 1-250560

[51] Int. Cl.[6] ..... B41J 2/36

[52] U.S. Cl. ..... 347/192; 347/194

[58] Field of Search ..... 347/188, 194, 347/189, 192, 190; 400/120.09, 120.12, 120.14, 120.1

[56] References Cited

U.S. PATENT DOCUMENTS

| | | | |
|---|---|---|---|
| 4,309,712 | 1/1982 | Iwakura | 346/76 PH |
| 4,370,666 | 1/1983 | Noda et al. | 346/76 PH |
| 4,415,908 | 11/1983 | Sugiara | 346/76 PH |
| 4,479,132 | 10/1984 | Iwakura | 346/76 PH |
| 4,514,737 | 4/1985 | Suzuki | 366/76 PH |
| 4,684,959 | 8/1987 | Mori et al. | 346/76 PH |
| 4,827,286 | 5/1989 | Sugiara et al. | 346/76 PH |
| 4,870,428 | 9/1989 | Kuwabara et al. | 346/76 PH |

FOREIGN PATENT DOCUMENTS

| | | | |
|---|---|---|---|
| 0086784 | 7/1981 | Japan | 400/120 |
| 0235166 | 10/1986 | Japan . | |

*Primary Examiner*—Huan H. Tran

*Attorney, Agent, or Firm*—Fitzpatrick, Cella, Harper & Scinto

[57] ABSTRACT

A recording apparatus includes a heat generating element which is driven to generate heat and thereby effect image recording on a recording medium. In the apparatus, a reference voltage for driving the heat generating element is set, and a driving voltage based on the reference voltage is output. A signal is detected which corresponds to an amount of electric power supplied to the heat generating element during image recording. A control unit controls the outputting of the driving voltage based on the amount of electric power, and adjusts the energy to be applied to the heat generating element.

45 Claims, 12 Drawing Sheets

RECORDING METHOD AND APPARATUS MAINTAINING CONSTANT DENSITY BY ANTICIPATING TEMPERATURE CHANGES IN THE RECORDING HEAD

This application is a continuation of application Ser. No. 08/240,213 filed May 9, 1994, now abandoned, which in turn is a continuation of application Ser. No. 08/003,956 filed Jan. 19, 1993, now abandoned, which in turn is a continuation of application Ser No. 07/632,644 filed Dec. 26, 1990, now abandoned, which in turn is a continuation of application Ser. No. 07/420,018 filed Oct. 11, 1989 now abandoned.

BACKGROUND OF THE INVENTION

1. Field of the Invention

This invention relates to a recording method and apparatus for effecting recording of images on a recording medium by the use of heat.

The term "recording apparatus" covers apparatuses having the recording function, such as an electronic typewriter, a printer, a facsimile apparatus and a copying apparatus.

2. Related Background Art

Description will hereinafter be made with a heat transfer printer taken as an example of the recording apparatus.

Generally, in the thermal head of a heat transfer printer or the like, the efficiency of energy transmitted to an ink sheet is very low for the energy applied to the thermal head, and the value thereof is said to be about 50% or less. This loss of heat is due to the transmission or radiation of heat to the base material of the thermal head and into the air. Like this, the energy applied to the thermal head is not all used for the heating of the ink sheet, but the amount of heat generated by the thermal head is very greatly affected by the environment in which the apparatus is placed and the data recorded.

So, as a method of controlling the amount of heat generated by a heat generating member in such a thermal head, there has been practiced the history correction in which the energy applied to the thermal head is adjusted on the basis of the recording information for several lines in the past, or the accumulated heat correction in which the general temperature rise of the glaze layer of the thermal head is foreseen on the basis of the recording data and the energy applied to the thermal head is adjusted.

Of these, a popular method used in the latter accumulated heat correction is such that in the case, for example, of a serial type heat transfer printer, how many black dots have existed between the head of the currently printed line to the line to be printed next is counted and the applied energy is controlled stepwise on the basis of the counted value. Accordingly, if spaces are included in that line, the applied energy is increased at a predetermined ratio in conformity with the amount of the spaces. The purpose of such accumulated heat correction is to keep the recording density in that line uniform and further keep the recording density from the beginning to the end of each page uniform.

However, the conventional accumulated heat correction method has suffered from the problems shown below.

[1] When the recording (printing) speed is low

For example, if an underlined character row is printed and thereafter only the underline is printed, the print of the underline portion becomes thin. This is because the underline is continuous and therefore the portions corresponding to spaces become absent and due to the accumulated heat correction process, the energy applied to the thermal head continues to fall stepwise.

[2] When the recording (printing) speed is high (a) The period of energy application to the thermal head becomes faster and therefore, as compared with the case of printing of ordinary documents, if recording of figures or graphics is effected, a sudden change in the recording dot density cannot be accommodated and thus, the recording density becomes too high.

(b) Also, for the same reason as in the case of item (a) above, owing to the difference in character pitch or character font, or further if bold characters, double-width characters or quadruple square characters are printed, the recording density of those characters becomes high.

(c) The control of the recording density effected on the basis of the number of black dots is usually executed under the control of a CPU or the like and therefore, if the recording speed becomes higher, the burden of the CPU increases. Therefore, in the conventional accumulated heat correction, the recording speed cannot be increased beyond a certain speed, and so there has been an upper limit on the speed.

SUMMARY OF THE INVENTION

It is an object of the present invention to provide a recording method and apparatus which can provide clear-cut recordings.

It is another object of the present invention to provide a recording method and apparatus which can keep the recording density constant.

It is still another object of the present invention to provide a recording method and apparatus which can perform the accumulated heat correction on a recording head.

It is yet another object of the present invention to provide a recording method and apparatus in which the temperature increase of a recording head is predicted based on the value of electric current or electric power consumed by the recording head and which can properly accomplish the accumulated heat correction of the recording head on the basis of the anticipated temperature rise.

It is another object of the present invention to provide a heat transfer recording apparatus in which the temperature rise of a thermal head is predicted from the value of electric current or electric power consumed by the thermal head and the driving voltage of the thermal head is adjusted correspondingly to that temperature rise, whereby the accumulated heat correction of the thermal head can be properly accomplished to keep the recording density constant.

DESCRIPTION OF THE PREFERRED EMBODIMENTS

Embodiments which will hereinafter be described are such that a reference driving voltage for driving a thermal head to generate heat is set and a driving voltage for the thermal head is output on the basis of the reference driving voltage and during image recording, the value of electric power or electric current supplied to the thermal head is detected and the driving voltage for the thermal head is adjusted on the basis of the detected value of electric power or electric current.

Preferred embodiments of the present invention will hereinafter be described in detail with reference to the accompanying drawings.

DESCRIPTION OF HEAT TRANSFER PRINTER (FIG. 9)

Figure 9:
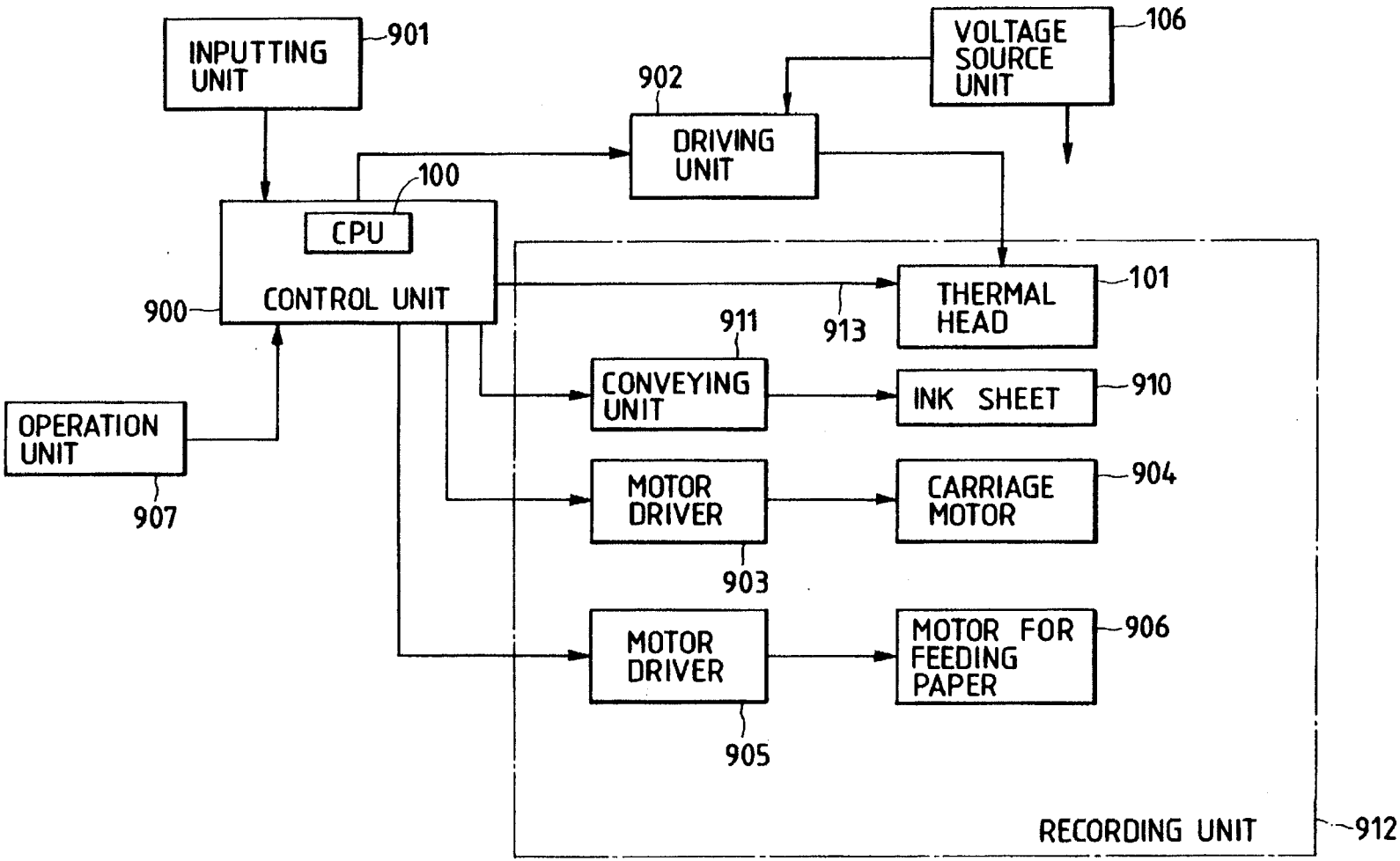
FIG. 9 is a block diagram schematically showing the construction of a serial type heat transfer printer according to an embodiment of the present invention.

FIG. 9 is a block diagram schematically showing the construction of a serial type heat transfer printer according to an embodiment of the present invention.

In FIG. 9, the reference numeral 900 designates a control unit for controlling the entire printer. The control unit 900 is provided with a CPU 100 such as a microprocessor and an RAM used as a work area. The reference numeral 901 denotes an inputting unit for inputting recording data or the like from an outside instrument such as a host computer, and the reference numeral 902 designates a driving circuit outputting a driving voltage for driving a thermal head 101. The driving circuit 902, as will be described later, is provided with an adjusting circuit for adjusting the driving voltage of the thermal head 101 with the temperature rise of the thermal head 101. The reference numeral 913 denotes recording data. The control unit 900 drives a plurality of heat generating elements (heat generating resistance members) 72 of the thermal head 101 in accordance with the recording data 913. The reference numeral 904 designates a carriage motor for conveying a carriage carrying the thermal head 101, an ink sheet 910 (an ink ribbon cassette), etc. thereon in a direction orthogonal to the scanning direction of recording paper. The reference numeral 906 denotes a paper feeding motor for conveying the recording paper in the sub-scanning direction. The reference numerals 903 and 905 designate motor drivers for driving the carriage motor 904 and the paper feeding motor 906, respectively. The reference numeral 106 denotes a voltage source unit for supplying a voltage to the driving circuit 902 for the thermal head and to the driver circuits and control circuits of the respective motors.

The reference numeral 907 designates an operation unit provided with a line feed switch for directing the conveyance of the recording paper, a select switch for directing on-line, etc. The reference numeral 910 denotes an ink sheet for transferring to the recording paper ink heated by the thermal head 101 and melted or sublimated. The ink sheet 910 is, for example, an ink ribbon contained in a cartridge or the like. The reference numeral 911 designates a conveying unit for conveying the ink sheet 910 according to the conveyance of the carriage. The conveying unit 911 is comprised, for example, of a motor for taking up the ink ribbon and a mechanism portion for taking up the ink sheet 910 with the movement of the carriage, etc. The reference numeral 912 denotes a recording unit comprising the thermal head 101, various motors, a transmission mechanism system therefor, etc.

DESCRIPTION OF THERMAL HEAD (FIGS. 7 AND 8)

Figure 7:
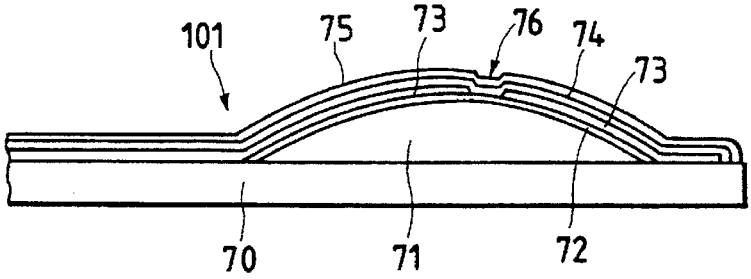
FIG. 7 is a cross-sectional view of a thermal head.

FIG. 7 is an enlarged view of the vicinity of the heat generating portions of the thermal head 101.

In FIG. 7, the reference numeral 70 designates a base member formed of a material of high heat conductivity such as alumina ($Al_2O_3$) or ceramic. The reference numeral 71 denotes a glaze layer portion on which a plurality of heat generating elements (heat generating resistance members) 72, an aluminum electrode 73, an oxidation preventing layer 74 and a wear-proof layer 75 are formed in superposed relationship with one another as shown. Portions indicated by 76 in which the aluminum electrode 73 is removed by etching are the heat generating portions of the thermal head 101.

Figure 8:
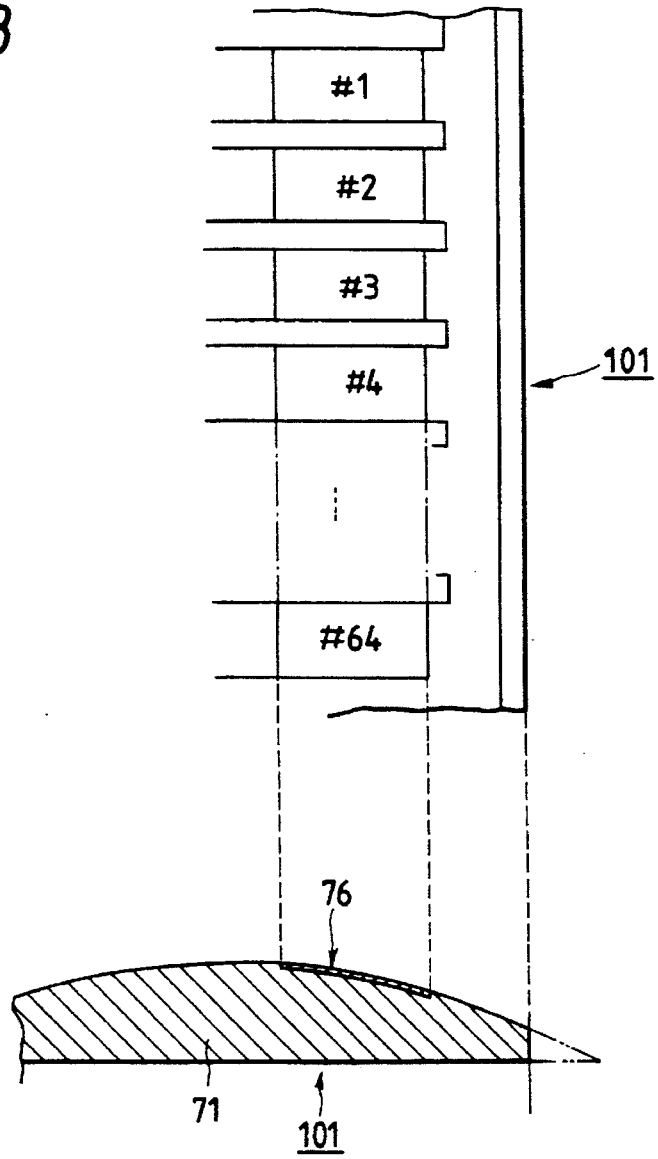
FIG. 8 shows the front and cross-sectional shape of the thermal head.

FIG. 8 shows a front view of the thermal head 101 shown in FIG. 7 as it is seen from a surface having the heat generating portion 76 (a recording surface) and the cross-sectional shape thereof.

In FIG. 8, heat generating portions (76) corresponding to 64 dots which are disposed in a longitudinal direction (a direction orthogonal to the direction of movement of the thermal head 101 are designated by #1–#4). This thermal head is moved by the drive of the carriage motor 904 in a direction (lateral direction) orthogonal to the direction (longitudinal direction) in which the heat generating portions 76 corresponding to 64 dots are arranged, and effects recording serially on the recording paper. Although not shown in FIG. 7, a heat sink such as an aluminum piece is adhesively secured to that side (the underside as viewed in FIG. 7) of the base member 70 which is opposite to the side on which the heat generating portions 76 are provided, and radiates the quantity of heat of the thermal head 101 to thereby prevent the thermal head 101 from being overheated.

It is seen from the structure of the thermal head 101 shown in FIG. 7 that about 50% of the quantity of heat produced from the heat generating portions 76 is absorbed by the glaze layer 71. Accordingly, it is considered that the temperature rise in the heat generating portions 76 has a time constant of 50–100 msec. and further the heat conduction from the glaze layer 71 to the base member 70 has a time constant of 500 msec. or more.

The accumulated heat correction in such a thermal head will now be specifically described.

Figure 1:
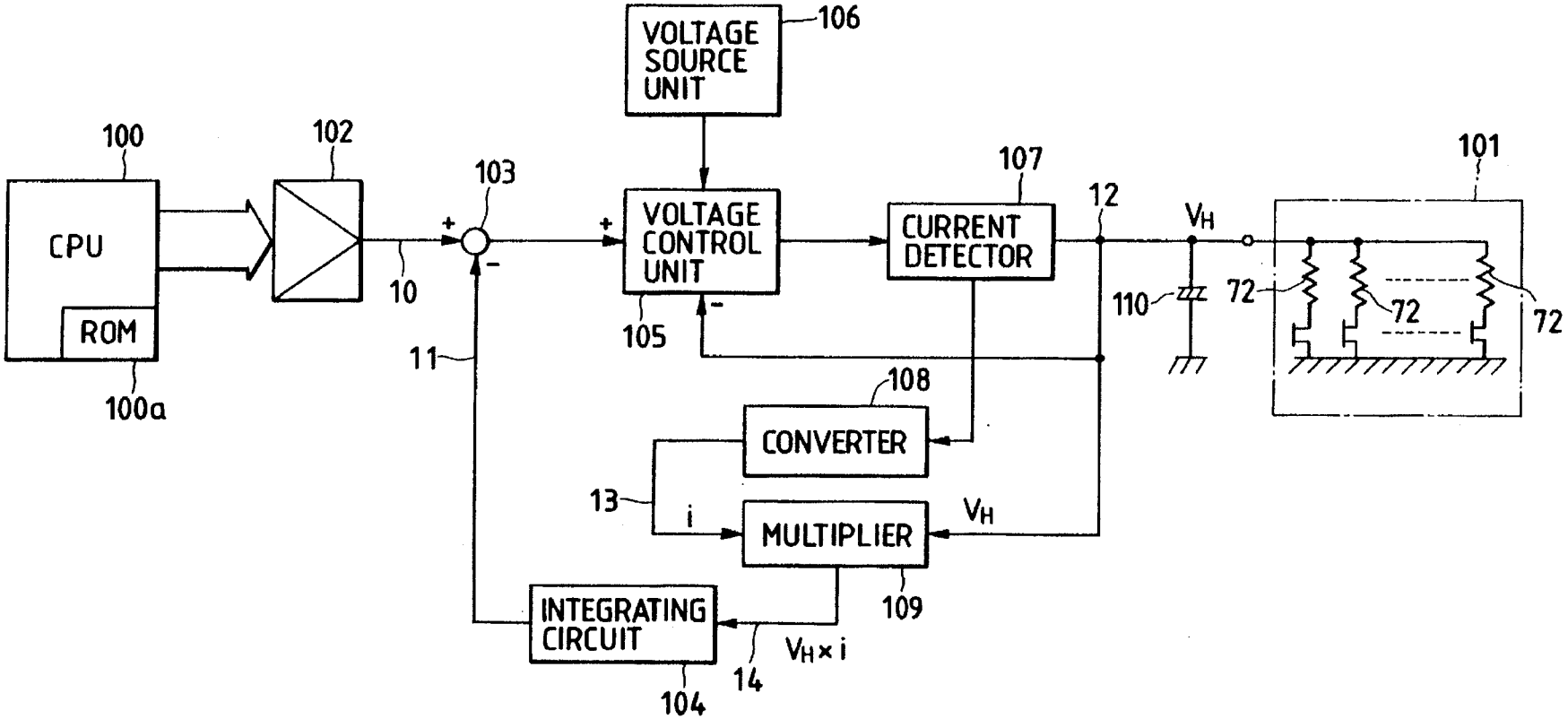
FIG. 1 is a block diagram schematically showing the construction of a driving circuit for a thermal head in a heat transfer printer according to a first embodiment of the present invention, FIG. 2 diagrammatically shows a specific example of the circuit of FIG. 1.
Figure 2:
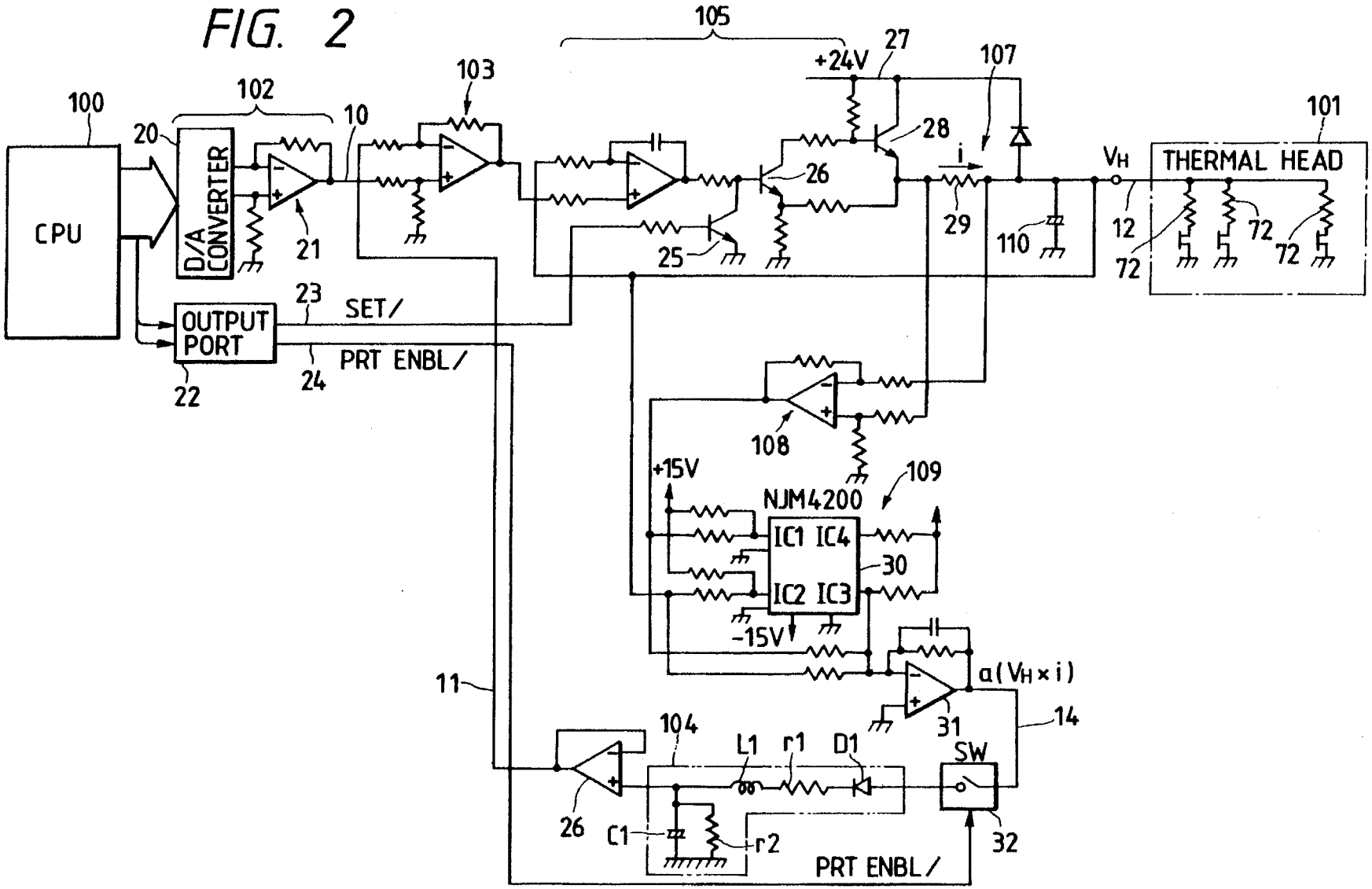
Figure 3:
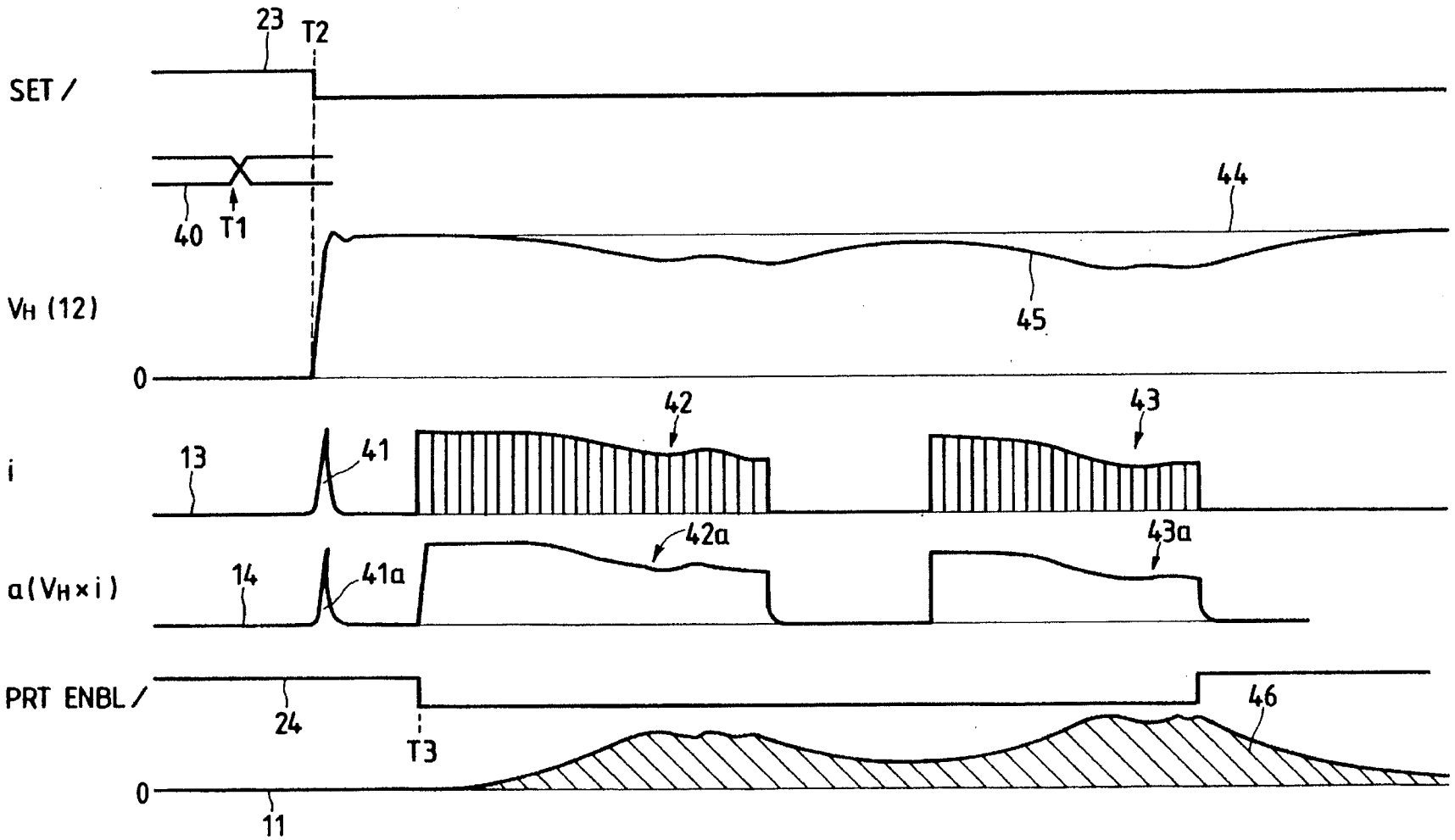
FIG. 3 shows examples of the waveform and timing of each sisal in the circuit of FIG. 2.

Description of the Driving Voltage Control Circuit of the Thermal Head (FIGS. 1–3)

FIG. 1 is a block diagram schematically showing the construction of the driving circuit 902 for the thermal head in a heat transfer printer to which an embodiment of the present invention is applied.

In FIG. 1, when the power source switch of the printer is closed, the CPU 100 of the control unit 900 determines the driving voltage of the thermal head 101 on the basis of the ambient temperature of the printer or the temperature of the thermal head 101, and further the average resistance value information of the heat generating portions 76 of the thermal head 101. The CPU 100 then outputs a digital value corresponding to this driving voltage value to a D/A converter 102. When it receives the digital value from the CPU 100, the D/A converter 102 outputs to a differential amplifier 103 an analog signal 10 having a voltage value corresponding to the digital value.

The differential amplifier 103 receives as inputs the analog signal 10 from the D/A converter 102 and a voltage signal 11 from an integrating circuit 104 which will be described later, and carries out the calculation of (analog signal 10)–(voltage signal 11), and outputs a voltage which is the result of the calculation to a voltage control unit 105. At the stage before the thermal head 101 is driven, the output of the integrating circuit 104 is "0" and therefore, the differential amplifier 103 outputs the analog signal 10 intact from the D/A converter 102 to the voltage control unit 105.

The voltage control unit 105 receives as an input the voltage signal from the differential amplifier 103, and prepares and outputs the driving voltage of the thermal head corresponding to the input voltage. Also, this voltage control unit 105 receives as an input the voltage value $V_H$ of the applied signal 12 to the thermal head 101, and feedback-controls this voltage value $V_H$ so that it is kept constant. The reference numeral 106 designates a voltage source unit producing a voltage higher than the applied voltage $V_H$. The reference numeral 107 denotes a current detector of low impedance inserted between the voltage control unit 105 and the thermal head 101. The current detector 107 measures an electric current (i) supplied to the thermal head 101 and outputs the result of the measurement to a converter 108.

When it receives the current value from the current detector 107, the converter 108 outputs a voltage signal 13 having a voltage corresponding to that current value. A multiplier 109 receives as inputs this voltage signal 13 and the applied signal 12 to the thermal head 101, and multiplies these two signals. A signal 14 having a voltage corresponding to the result of the multiplication is input to the integrating circuit 104. Thus, the multiplier 109 outputs the supplied electric power ($V_H$·i) to the thermal head 101.

The integrating circuit 104 receives as an input the supplied electric power value from the multiplier 109 and serially effects the integration thereof, thereby outputting to the differential amplifier 103 a voltage signal 11 indicative of the predicted value having predicted the temperature rise of the entire glaze layer 71 (FIG. 7) of the thermal head 101. In this manner, the differential amplifier 103 substracts the voltage signal 11 having foreseen the temperature rise, from the analog signal 10 indicative of the applied voltage to the thermal head 101 input from the D/A converter 102, thereby outputting to the voltage control unit 105 a voltage value taking the temperature rise of the thermal head 101 into account. Thus, a driving voltage conforming to the general temperature rise of the thermal head 101 can be produced.

A capacitor 110 is connected between the applied signal 12 to the thermal head 101 and the ground to smooth the voltage applied to the thermal head 101. Also, during the initial setting of the driving voltage $V_H$ of the applied signal 12, a charging current flows to the capacitor 110 and therefore, the electric power supplied to the thermal head 101 becomes greater than the actual supplied electric power. Correction of this will be described later.

FIG. 2 diagrammatically shows a specific example of the thermal head driving circuit in the heat transfer printer of the present embodiment shown in FIG. 1, and in FIG. 2, portions common to those in FIG. 1 are designated by identical reference numerals.

In FIG. 2, the reference numeral 20 designates a D/A converter which receives as an input a digital signal from the CPU 100 and outputs a voltage signal corresponding to the digital signal. The output of this D/A converter 20 is amplified by an amplifying circuit 21 comprising of an operational amplifier and is input to the non-inverting input terminal (+) of an operational amplifier circuit constituting the differential amplifier 103. Here, a set signal (SET/: /indicates that it is a low active signal) and a printable signal 24 (PRTENBL/1) are both output at a high level through an output port 22. Accordingly, at this time, a voltage "0" is input to the inverting input (–) of the differential amplifier 103.

When a recording start command is input to the CPU 100, the CPU 100 sets the set signal 23 to a low level through the output port 22. Thereby a transistor 25 is turned off and therefore, a transistor 26 and a PNP transistor 28 are turned on. Thus, through the intermediary of a voltage source line 27, a voltage (24 V) from the voltage source unit 106 is supplied to the thermal head 101 through the transistor 28.

The reference numeral 29 denotes a resistor for detecting a current value (i) supplied to the thermal head 101, and the resistor 29 is of low resistance, e.g. 0.1 ψ. By the current i flowing through this resistor 29, a potential difference produced across the resistor 29 is input to an operational amplifier constituting the converter 108, and is amplified thereby and output to the multiplier 109. In this converter 108, for example, conversion of 0.5 V/1 A is carried out. As a multiplying circuit 30 constituting the essential portion of the multiplier 109, use is made, for example, of NJM4200 produced by JRC. The reference numeral 31 designates an amplifying circuit which outputs a voltage value a ($V_H$×i) obtained by amplifying the output ($V_H$×i) of the multiplying circuit 30.

The reference numeral 32 denotes a switch circuit adapted to be closed when the printable signal 24 assumes a low level by the instruction of the CPU 100. Accordingly, when the printable signal 24 assumes a low level by the CPU 100, the output from the multiplier 109 is input to the integrating circuit 104. This integrating circuit 104 is comprised of a serial circuit comprising a diode D1, a resistor r1 and an inductor L1, and a resistor r2 parallel-connected to a capacitor C1. The constants of these constituents can be empirically obtained by the heat accumulating characteristic of the thermal head 101, as shown below.

Here, r1 is determined by the heat resistances of the heat generating members 72 and the glaze layer 71, and in the experiment, it is about 1.2 K ψ. L1 is the heat buffer coefficient of the entire glaze layer 71 functioning as a thermal damper material, and in the experiment, it is 10 mH. C1 is determined by the heat capacity of the entire glaze layer 71 (the capacity of the glaze layer 71), and is e.g. 1 μF. r2 is determined by the heat resistance between the glaze layer 71 and the base member 70, and in the experiment, it is about 100 K ψ. D1 designates a back flow preventing diode.

The reference numeral 26 denotes a circuit for impedance-converting the potential of the capacitor C1, and the output voltage of this circuit 26 is approximate to the temperature rise value of the entire glaze layer. The output of this circuit 26 is input to the inverting input terminal (–) of the operational amplifier constituting the differential amplifier 103, and effects a subtraction so that energy corresponding to the temperature rise of the glaze layer of the thermal head 101 is supplied to the thermal head 101.

FIG. 3 is a timing diagram showing the waveforms of various signals during the aforedescribed operation.

In FIG. 3, the reference numeral 44 indicates a digital voltage value output from the CPU 100, and this digital voltage value is set in the D/A converter 20 at timing T1. Next, at timing T2, the set signal 23 assumes a low level, whereby the voltage from the voltage source unit 106 is supplied to the thermal head 101 through the transistor 28. Thus, the voltage of the applied signal 12 rises to $V_H$. The reference numeral 13 indicates a current value flowing through the resistor 29. The portion indicated by 41 is a charging current flowing to the capacitor 110, and 41*a* indicates an electric power value output from the multiplier 109 by this charging current. At this point in time, however, the printable signal 24 is not output and therefore, there is no possibility of the consumed electric power during the charging by the capacitor 110 correcting the input voltage of the voltage control unit 105.

When at timing T3, the printable signal 24 assumes a low level and the printing operation is started, an electric current is caused to flow to the thermal head 101 in conformity with the recording operation, as indicated by 42 and 43. The reference characters 42*a* and 43*a* indicate the electric power consumed by the thermal head 101 at this time. Since in this state, the printable signal 24 is at a low level, this electric power value is input to the integrating circuit 104 through the switch 32. By the aforedescribed construction, the integrating circuit 104 outputs to the differential amplifier 103 a signal 11 related to the temperature rise of the glaze layer of the thermal head 101. Thus, the output voltage value of the differential amplifier 103, as indicated by 43, assumes a voltage level lower than the maximum driving voltage level of the thermal head 101 indicated by 44.

Thus, the variation in the voltage signal 11 as shown in FIG. 3 is properly changed corresponding to the temperature of the thermal head which rises according to the recorded image pattern, the recording speed, etc.

Figure 4:
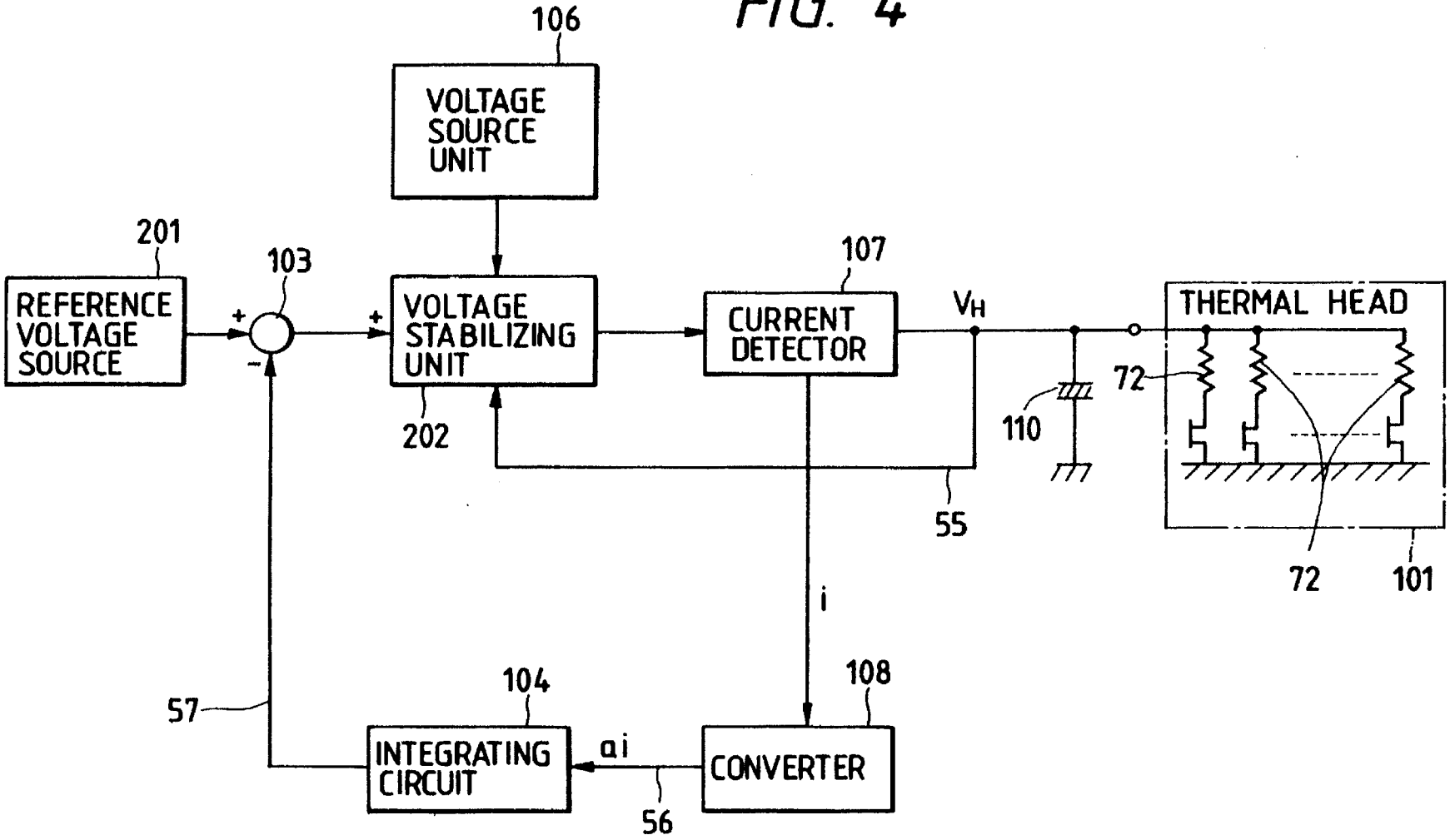
FIG. 4 is a block diagram schematically showing the construction of a driving circuit for a thermal head in a heat transfer printer according to a second embodiment of the present invention.
Figure 5:
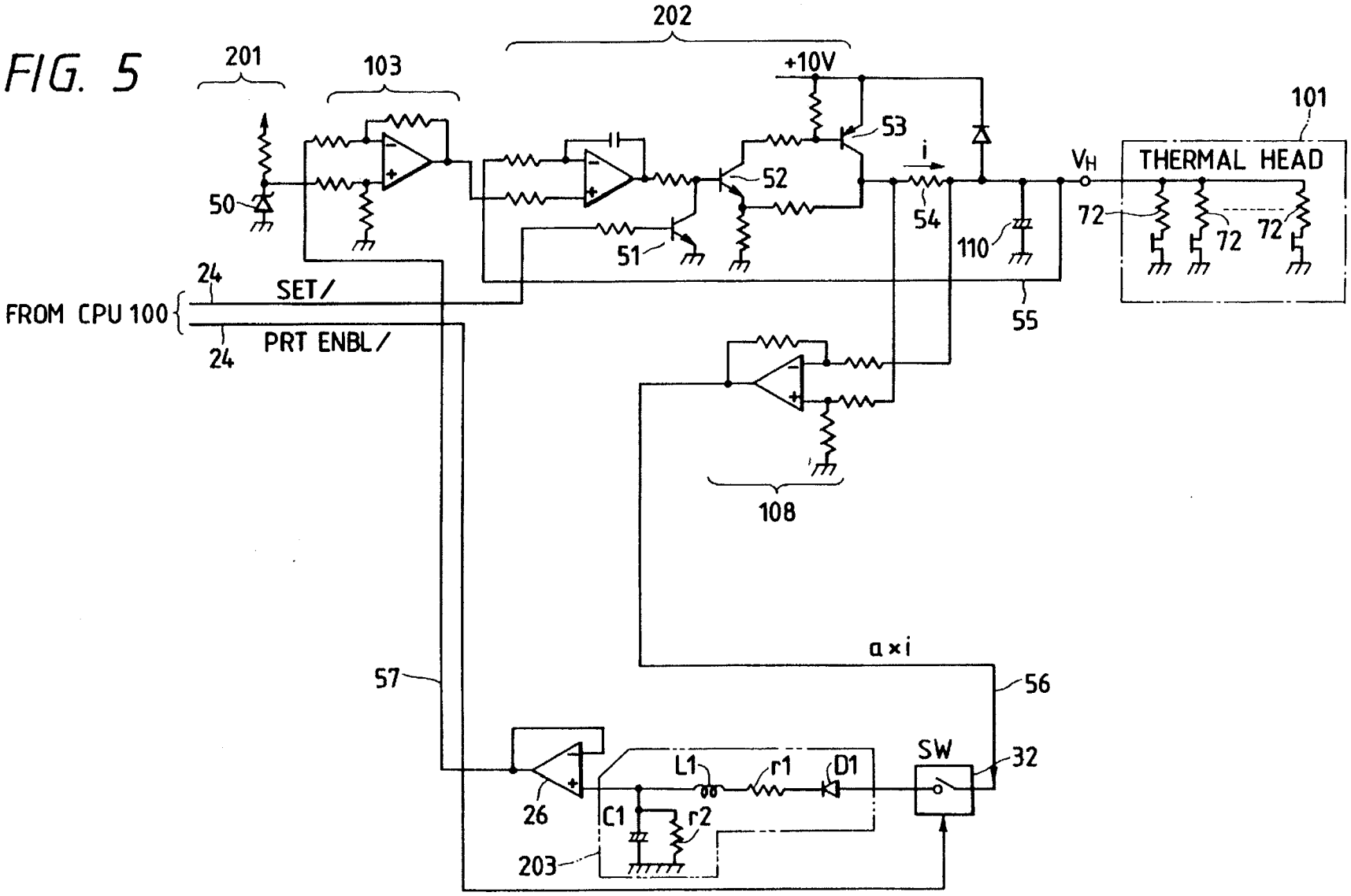
FIG. 5 shows a specific example of the circuit of FIG. 4.
Figure 6:
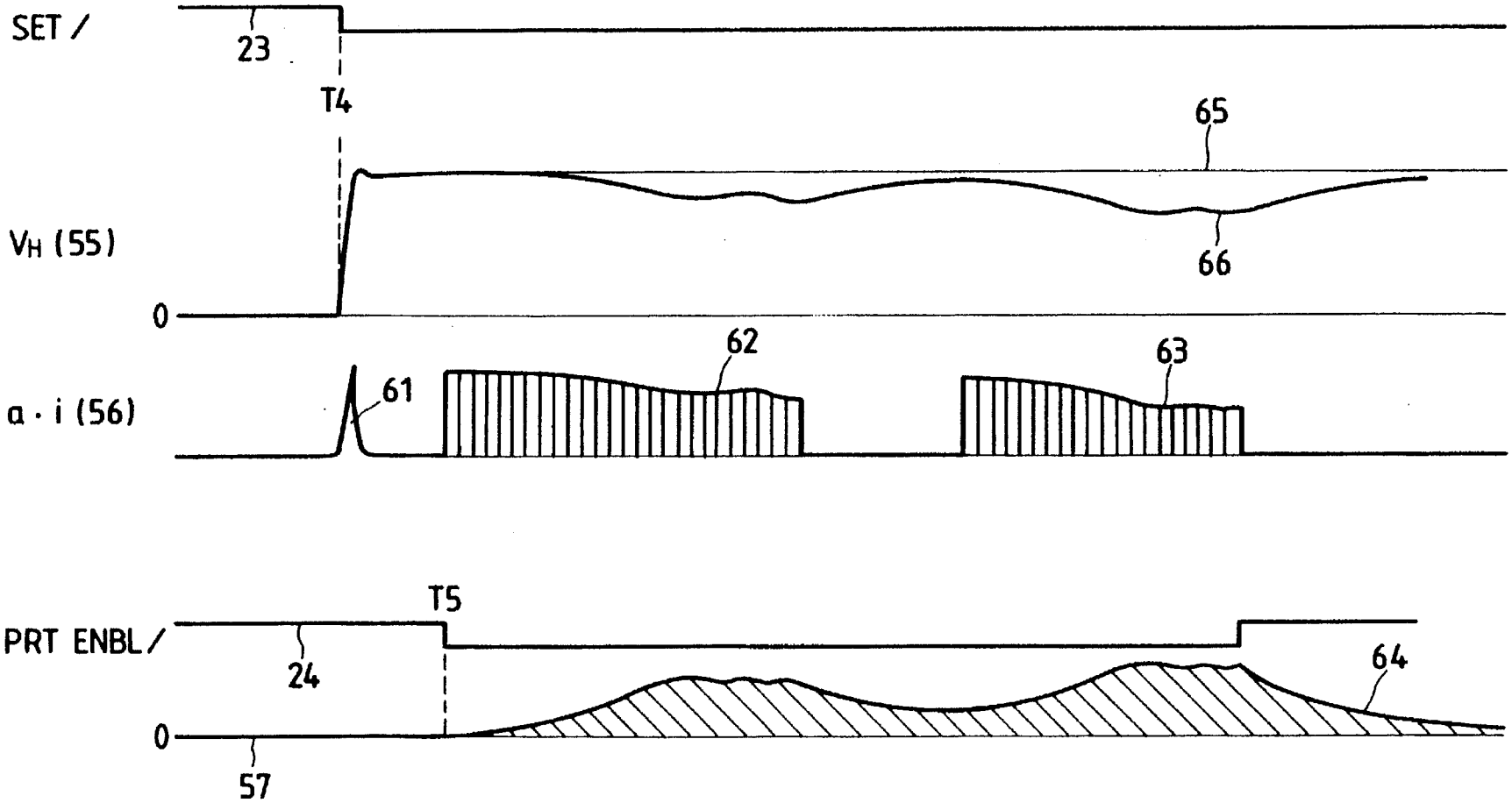
FIG. 6 shows examples of the waveform and timing of each signal in the circuit of FIG. 5.

Description of Second Embodiment (FIGS. 4–6)

FIG. 4 is a block diagram schematically showing the construction of a thermal head driving circuit in a heat transfer printer according to a second embodiment, and in FIG. 4, portions common to those in FIG. 1 are designated by identical reference numerals. Here, as is apparent from the comparison of FIG. 4 with FIG. 1, in the second embodiment, the driving voltage of the thermal head 101 is not set by the CPU 100. Accordingly, this second embodiment is premised on a heat transfer printer in which the driving voltage of the thermal head 101 is not varied very much corresponding to the printing mode or the like. Here, by regarding the driving voltage as being approximately constant, the relation that the supplied electric power ∝ the supplied electric current is established and therefore, an effect similar to that of the first embodiment can be obtained by the construction of FIG. 4.

The reference numeral 201 designates a reference voltage source producing a reference voltage for determining the reference driving voltage of the thermal head 101. The reference numeral 202 denotes a voltage stabilizing unit for receiving as an input a voltage resulting from subtracting the voltage value from the integrating circuit 104 from the voltage from the reference voltage source 201, and producing a corresponding driving voltage. The operation of this voltage stabilizing unit 202 is substantially the same as that of the voltage control unit 105 in the aforedescribed first embodiment.

FIG. 5 is a circuit diagram showing a specific example of the circuit comprising the construction of FIG. 4, and FIG. 6 shows examples of the timing and waveform of each signal in this circuit. In FIG. 5, portions identical to those in FIG. 2 are designated by identical reference numerals.

The reference voltage source 201 is comprised of a Zener diode 50. The reference numeral 103 designates a differentiation amplifier receiving as inputs a voltage from the Zener diode which produces a reference voltage and a voltage signal 57 from an integrating circuit 203, and taking the differential therebetween and outputting it. The reference numeral 202 denotes a circuit which, when it receives as an input the set signal (SET/) 23 from the CPU 100, turns off a transistor 51 and turns on transistors 52 and 53 and outputs a driving voltage to the thermal head 101.

The reference numeral 54 designates a resistor for detecting a current value supplied to the thermal head 101, and it is e.g. 0.1 ψ. The reference numeral 108 denotes a voltage converting circuit for converting the current value detected by the resistor 54 into a voltage signal. The output 56 of this converting circuit 108 is expressed as a x i, and this output 56 is designed so as to be e.g. 2.0 V/1 A. Switch 32, as in the first embodiment, is closed by the printable signal (PRTENBL/) 24 from the CPU 100 assuming a low level. The constituents of the integrating circuit 203, as in the case of the circuit of FIG. 2 (the first embodiment), can be empirically obtained by the heat accumulating characteristic of the thermal head 101. The output of this integrating circuit 203 is impedance-converted by an operational amplifier 26, and puts out to the differential amplifier 103 a signal 57 approximate to the temperature rise of the entire glaze layer of the thermal head 101.

FIG. 6 shows the timing of each signal in the circuit shown in FIG. 5.

When at timing $T_4$, the set signal 23 assumes a low level, the supply of electric power to the thermal head 101 is started and a driving voltage 55 rises. The reference numeral 61 indicates an electric current flowing for the charging of the capacitor 110. When at timing T5, the printable signal 24 is output from the CPU 100 at a low level, the switch 32 becomes closed and therefore, a voltage signal 57 is output from the integrating circuit 203.

When the printing operation is started and the recording operation is executed, an electric current is supplied to the thermal head 101 as indicated by 62 and 63. The reference numeral 64 indicates a voltage output from the integrating circuit 203 on the basis of this current value, and this voltage signal 64, as in the first embodiment, is approximate to the temperature rise of the entire glaze layer of the thermal head 101 during recording. By this signal 64, the driving voltage of the thermal head 101, as indicated by 66, is suppressed to a level lower than the maximum driving voltage 65 correspondingly to the temperature rise of the thermal head 101.

Figure 11:
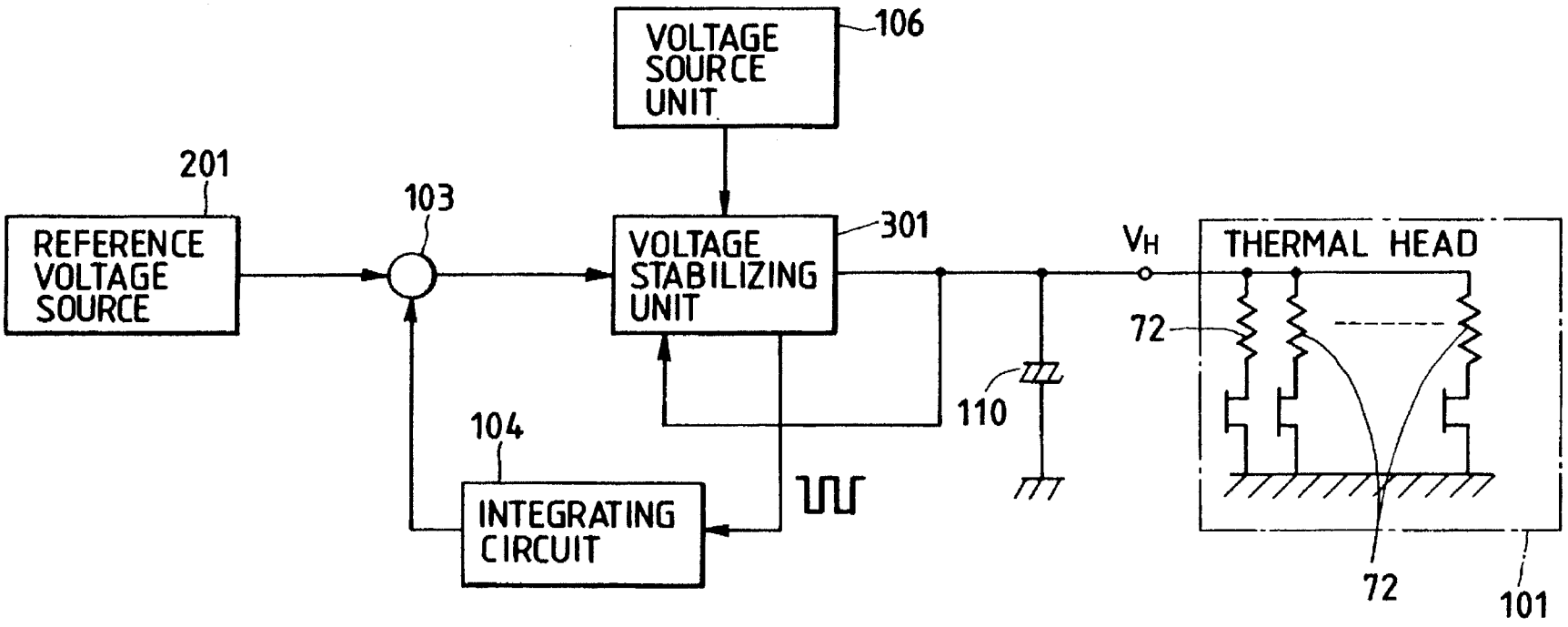
FIG. 11 is a block diagram schematically showing the construction of a thermal head driving circuit according a third embodiment.
Figure 12:
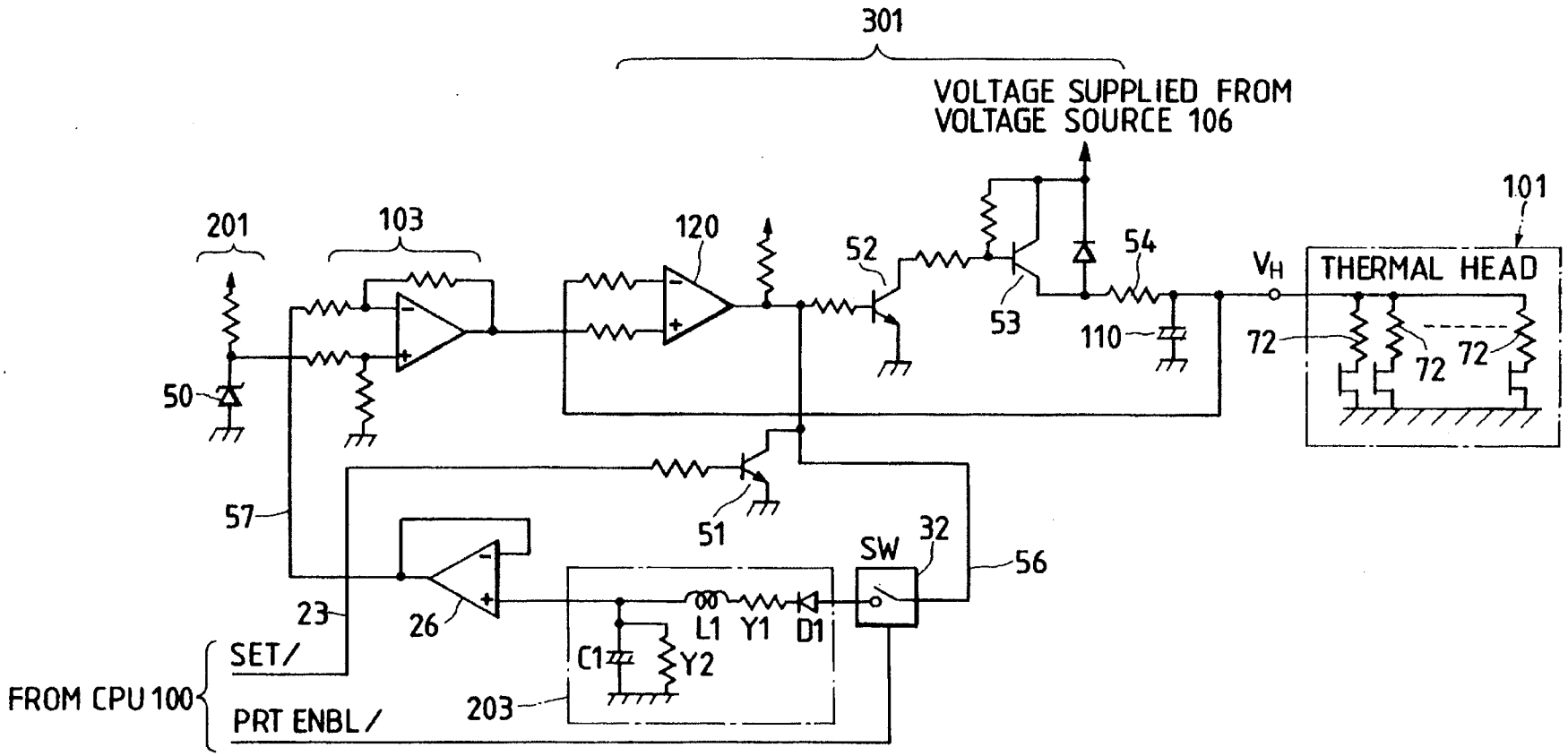
FIG. 12 shows a specific example of the circuit of FIG. 11.
Figure 13:
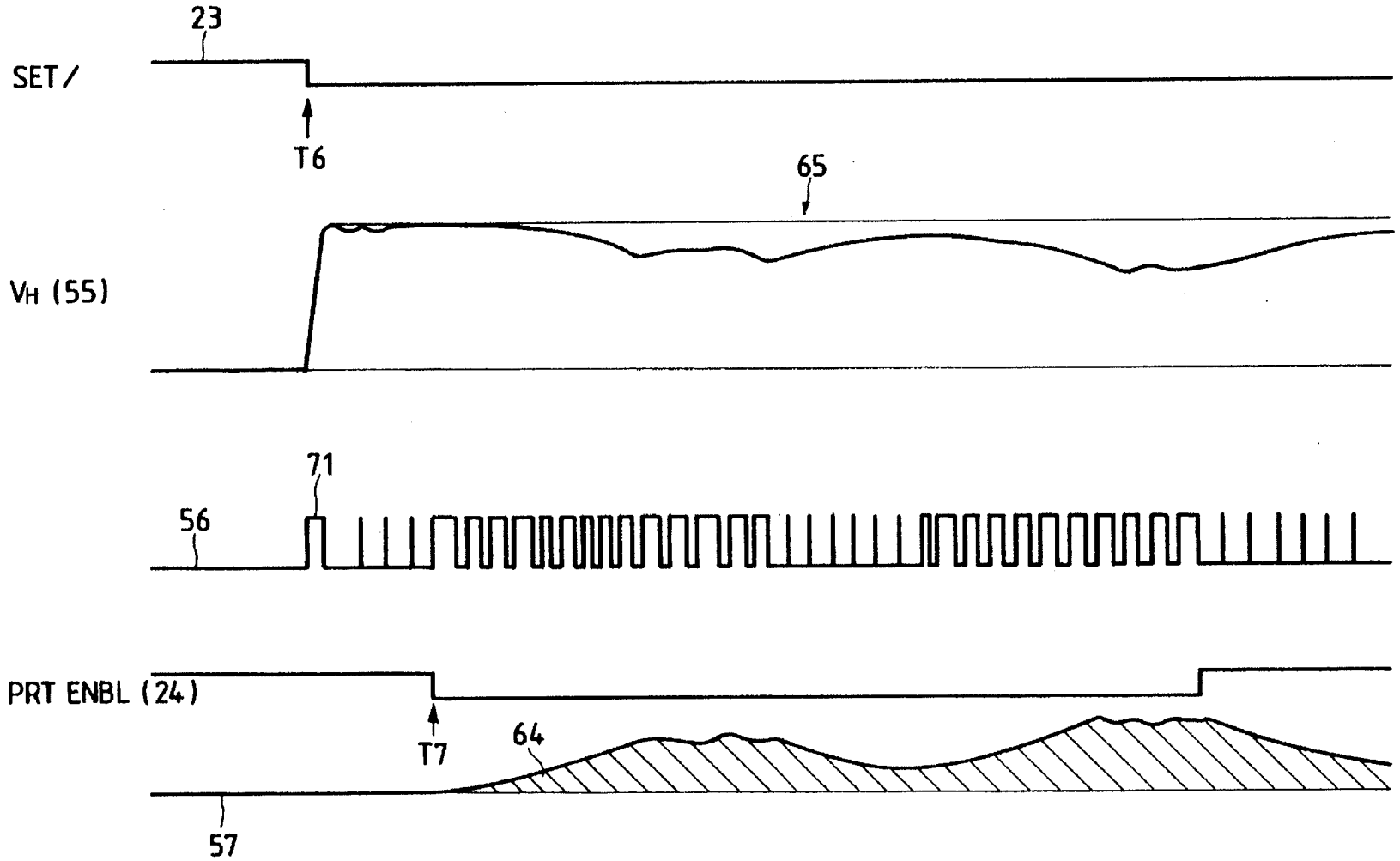
FIG. 13 shows the signal timings of various portions of the circuit of FIG. 12.

Description of Third Embodiment (FIGS. 11–13)

Still another embodiment will now be described.

FIG. 11 is a block diagram schematically showing the construction of a thermal head driving circuit in a heat transfer printer according to a third embodiment. In FIG. 11, portions common to those in FIG. 1 are designated by identical reference numerals.

As is apparent from the comparison of FIG. 11 with FIG. 1, in the third embodiment, the driving voltage of the thermal head 101 is not set by the CPU 100. Accordingly, this third embodiment is premised on a heat transfer printer in which the driving voltage of the thermal head 101 is not varied very much correspondingly to the printing mode or the like. In the case of this embodiment, a chopper type amplifier is used as a voltage stabilizing unit 301, and the relation that (the supplied electric power) ∝ (the on-duty of the voltage stabilizing unit 301) is approximately established and therefore, an effect similar to that of the first embodiment can be obtained by the construction of FIG. 11.

The reference numeral 201 designates a reference voltage source producing a reference voltage for determining the reference driving voltage of the thermal head 101. The reference numeral 301 denotes a voltage stabilizing unit for receiving as an input a voltage resulting from subtracting the voltage value from the integrating circuit 104 from a voltage from the reference voltage source 201, and producing a corresponding driving voltage, and this operation forms a voltage chopper type amplifying circuit. That is, the on-duty also becomes greater with an increase in the supplied electric power to the thermal head 101.

FIG. 12 is a circuit diagram showing a specific example of the circuit comprising the construction of FIG. 11, and FIG. 13 shows examples of the timing and waveform of each signal in this circuit. In FIG. 12, portions identical to those in FIG. 2 are designated by identical reference numerals.

The reference voltage source 201 is comprised of a Zener diode 50. The reference numeral 103 designates a differentiation amplifier receiving as inputs a voltage from the Zener diode 50 which produces a reference voltage and a voltage signal 57 from the integrating circuit 203, and taking the differential therebetween and outputting it. The reference numeral 301 denotes a circuit which, when it receives as an input a set signal (SET1:1) indicates that it is a low-active signal) 23 from the CPU 100, turns off a transistor 51 and turns on transistors 52 and 53 and outputs a driving voltage to the thermal head 101.

The reference numeral 54 designates a limiting resistor for stabilizing the chopper operation of the driving circuit, and the resistance value thereof is e.g. 0.1ψ–0.3 ψ. A comparator 120 has an open collector type output, and when the supplied voltage $V_H$ to the thermal head 101 is smaller than the output of the differential amplifier 103, a high potential is kept and, when the supplied voltage $V_H$ to the thermal head 101 becomes greater than the output of the differential amplifier 103, the output of the comparator substantially becomes a zero potential and works so as to turn off the driving transistor 53.

Switch 32, as in the first embodiment, is closed by the printable signal (PRTENBL/) from the CPU 100 assuming a low level. The integrating circuit 203, as shown, constitutes a so-called "charge pump" circuit. The constituents of this integrating circuit, as in the case of the circuit of FIG. 2 (the first embodiment), can be obtained empirically by the heat accumulating characteristic of the thermal head 101. The output of this integrating circuit 203 is impedance-converted by the operational amplifier 26, and is put out to the differential amplifier 103 which approximates the temperature rise of the entire glaze layer of the thermal head 101.

FIG. 13 shows the timing of each signal in the circuit shown in FIG. 12.

When at timing T6, the set signal 23 assumes a low level, the supply of electric power to the thermal head 101 is started and the driving voltage 55 rises. The reference numeral 71 indicates that the driving circuit is continually switched on for the charging of the capacitor 110. When at timing T7, the printable signal 24 is output from the CPU 100 at a low level, the switch 32 is closed and therefore, a voltage signal 57 is output from the integrating circuit 203.

When the printing operation is started and the recording operation is executed, a signal 56 indicative of the on-duty of the driving circuit becomes a signal of high duty if the printing density is high, and becomes a continuous pulse waveform of low duty if the recording density becomes low. The reference numeral 64 indicates a voltage output from the integrating circuit 203 on the basis of this current value, and this voltage signal 64, as in the first embodiment, is approximates the temperature rise of the entire glaze layer of the thermal head 101 during recording. By this signal 64, the driving voltage of the thermal head 101, as indicated by 66, is suppressed to a level lower than the maximum driving voltage 65 corresponding to the temperature rise of the thermal head 101.

Figure 10:
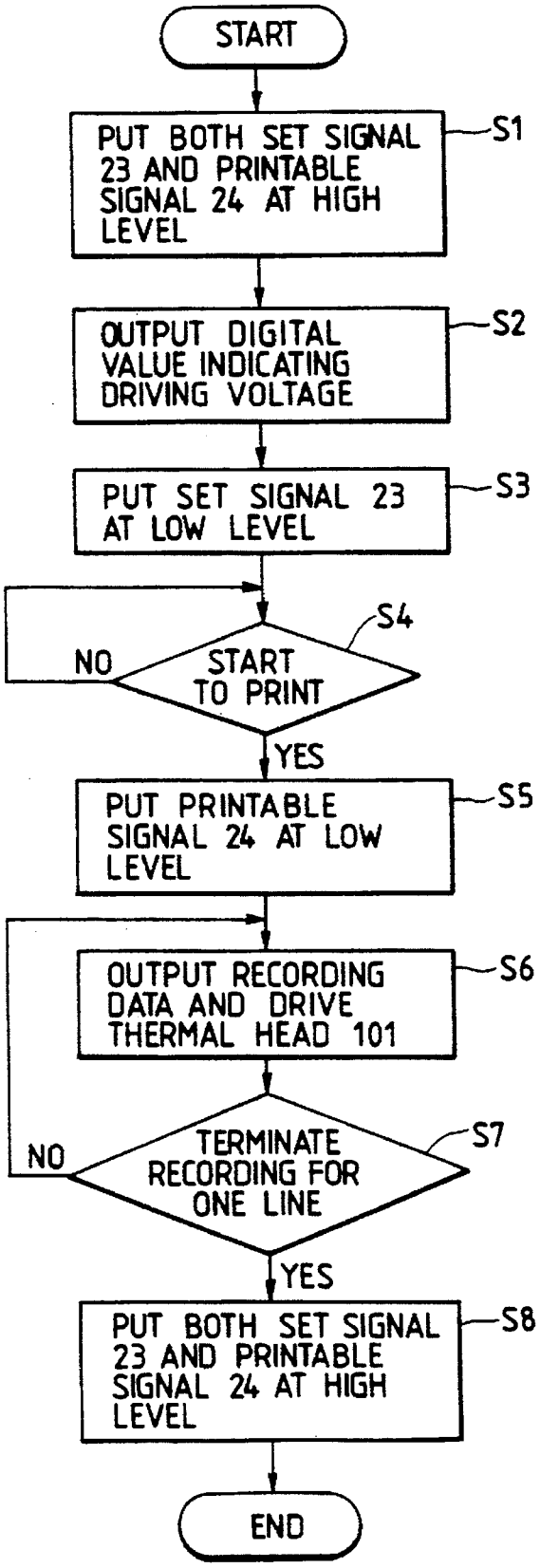
FIG. 10 is a flow chart showing the control operation in the printer of the embodiment.

Description of the Operation of CPU (FIG. 10)

The controlling operation of the control unit 900 by the CPU 100 in the first and second embodiments will now be described on the basis of the flow chart of FIG. 10. The control program for executing this control is stored in the ROM 100aof the control unit 900.

This process is started by recording data being input, for example, from an outside instrument and the recording starting condition being brought about. First, at step S1, both the set signal 23 and the printable signal 24 are output to the output port 22 so as to be set at a high level. At step S2, a digital value indicating the driving voltage of the thermal head 101 is output to the D/A converter 102. Thereby, a voltage value corresponding to the digital value is output from the D/A converter 102 to the differential amplifier 103. At step S3, the set signal 23 is set at a low level. Thereby, a driving voltage is output to the thermal head 101.

Next, at step S4, the print starting condition is waited for, and when the print starting condition is brought about, advance is made to step S5, and flow shifts to the printing process. At the step S5, the printable signal 24 is set at a low level and output. Thereby the switch 32 is closed, and the electric power value 14 ($V_H$×i) from the multiplier 109 is output to the integrating circuit 104. At this point in time, however, recording data is not output to the thermal head 101 and therefore, no electric current is flowing to the thermal head 101, and the voltage signal 11 output from the integrating circuit 104 is substantially "0". Thus, when the recording by the thermal head 101 is started, a voltage substantially equal to the driving voltage indicated by the CPU 100 is applied to the thermal head 101.

At step S6, recording data corresponding to one row is output to the thermal head 101, whereby the thermal head is driven to generate heat, and at step S7, whether the image recording process for one line has been terminated is examined. If the image recording process for one line is not terminated, return is made to the step S6, where the aforedescribed process is executed. During this image recording process, a voltage signal 11 as indicated, for example, at 46 in FIG. 3 is output corresponding to the electrically energized state of the thermal head 101, and the driving voltage $V_H$ of the thermal head 101 is adjusted by the differential amplifier 103 and the voltage control unit 105. When the recording process for one line is thus terminated, advance is made to step S8, where both the set signal 23 and the printable signal 24 are set at a high level and the process is terminated.

Also, in the case of the second embodiment, only the process of step S2 is unnecessary, and there is no difference in the other points.

This embodiment has been described with respect to a serial type heat transfer printer, whereas the present invention is not restricted thereto, but is also applicable to the image recording by a line type recording head.

The recording medium is not limited to recording paper, but may also be a material capable of recording, such as cloth or a plastic sheet.

According to this embodiment, as described above, the temperature of the thermal head at every moment which rises corresponding to the recording data is predicted and the voltage applied to the thermal head is adjusted corresponding to the temperature rise of the thermal head, whereby recording can be accomplished with more uniform density.

Also, according to this embodiment, recording can be accomplished always at constant density without being affected by the content of the recording data and the recording speed.

Further, according to this embodiment, it is not necessary to effect the accumulated heat correction of the thermal head by the CPU during the recording operation and therefore, the recording speed can be made high.

According to the present embodiment, as described above, the temperature rise of the heat generating elements is predicted from the value of the electric current, voltage or electric power consumed by the heat generating elements and the driving voltage of the heat generating elements is adjusted according to the temperature rise, whereby the accumulated heat correction of the heat generating elements can be effected properly and the recording density can be kept constant.

Although this embodiment has been described with respect to a heat transfer printer, the recording apparatus of the present invention is not restricted thereto, but can also be applied to any apparatus for effecting image recording on a recording medium by the use of heat, such as a thermosensitive recording apparatus in which heat generating elements are driven to generate heat and thereby effect recording on a thermosensitive sheet, or an ink jet recording apparatus in which ink droplets are produced by heat generation and recording is effected. Describing in more detail, recording apparatuses for effecting recording of images on a recording medium by the use of heat include the aforedescribed heat transfer recording apparatuses in which energy is applied to the thermal head to thereby cause the heat generating elements to generate heat and the ink of the ink sheet is transferred by the heat to thereby accomplish recording, thermosensitive recording apparatuses in which a thermosensitive sheet is caused to form a color by said heat to thereby accomplish recording, ink jet recording apparatuses in which heat energy generated from heat generating elements as heat energy generating members is utilized to discharge recording liquid from discharge ports and thereby accomplish recording, and so-called bubble jet recording apparatuses in which ink is discharged from discharge ports by the utilization of a sudden pressure change created by a bubble produced by heat energy generated from said heat generating elements as the heat energy generating members.

According to the present invention, as described above, there can be provided a recording method and apparatus which can keep the recording density constant.

I claim:

1. A recording apparatus in which a heat generating element at a recording means for recording generates heat and thereby effects image recording on a recording medium, comprising:

setting means for setting a reference voltage for driving said heat generating element to generate heat;

voltage outputting means for outputting a driving voltage of said heat generating element based on said reference voltage;

detecting means for detecting a signal corresponding to an amount of an electric power supplied to said heat generating element during said image recording;

accumulating means for accumulating said a value based on said signal corresponding to said amount of said electric power in a predetermined time period; and control means for anticipating a temperature change of said recording means in accordance with said value and controlling said voltage outputting means to adjust an energy to be applied to said heat generating element.

2. A recording method in which a heat generating element at a recording means for recording generates heat and thereby effects image recording on a recording medium, comprising the steps of:

setting a reference voltage to cause said heat generating element to generate heat;

detecting a current supplied to said heat generating element during image recording;

accumulating a value based on said current detected in said detecting step in a predetermined time period;

anticipating a temperature change of said recording means in accordance with said value accumulated in said accumulating step and outputting a driving voltage of said heat generating element in accordance with the temperature change anticipated in said anticipating step so as to control an energy to be applied to said heat generating element.

3. A recording apparatus in which a heat generating element at a recording means for recording generates heat and thereby effects image recording on a recording medium, comprising:

setting means for setting a reference voltage for driving said heat generating element to generate heat;

voltage outputting means for outputting a driving voltage of said heat generating element on the basis of said reference voltage;

detecting means for detecting a current supplied to said heat generating element during image recording;

accumulating means for accumulating a value based on said detected current in a predetermined time period; and control means for anticipating a temperature change of said recording means in accordance with a value of said value and controlling said voltage outputting means to adjust an energy to be applied to said heat generating element.

4. A recording method in which a heat generating element at a recording means for recording generates heat and thereby effects image recording on a recording medium, comprising the steps of:

setting a reference voltage to cause said heat generating element to generate heat;

accumulating a value based on an electric power supplied to said heat generating element in a predetermined time period;

anticipating a temperature change of said recording means in accordance with said value accumulated in said accumulating step; and outputting a driving voltage of said heat generating element in accordance with the temperature change anticipated in said anticipating step so as to control an energy to be applied to said heat generating element.

5. A recording apparatus in which a heat generating element at a recording means for recording generates heat and thereby effects image recording on a recording medium, comprising:

setting means for setting a reference voltage for driving said heat generating element to generate heat;

voltage outputting means for outputting a driving voltage of said heat generating element based on said reference voltage;

detecting means for detecting a voltage supplied to said heat generating element during image recording; and control means for anticipating a temperature change of said recording means in accordance with said voltage detected by said detecting means and producing a pulse signal in conformity with a voltage value of said driving voltage, and controlling a level of the driving voltage by said pulse signal.

6. A recording apparatus according to claim 5, wherein said control means further comprises comparing means for comparing an integrated voltage value obtained by integrating a duty ratio of said pulse signal with said reference voltage, and the duty ratio of said pulse signal is changed in conformity with a result of the comparison by said comparing means.

7. A recording method in which a heat generating element at a recording means for recording generates heat and thereby effects image recording on a recording medium, comprising the steps of:

setting a reference voltage to cause said heat generating element to generate heat;

detecting a current supplied to said heat generating element during image recording;

accumulating a value based on said current detected in said detecting step in a predetermined time period;

anticipating a temperature change of said recording means in accordance with the value accumulated in said accumulating step;

determining an electric power amount to be applied to said heat generating element in response to the temperature change anticipated in said anticipating step;

generating a pulse signal for driving said heat generating element;

outputting a driving voltage in accordance with said pulse signal so as to apply electric power to said heat generating element; and controlling said driving voltage in accordance with said reference voltage so as to apply to said heat generating element the electric power amount determined in said determining step.

8. A recording apparatus according to claim 1, wherein said heat generating element is a heat generating resistance member, and a thermal head is provided at said recording means, said thermal head comprising a plurality of such heat generating elements.

9. A recording method according to claim 2, wherein said heat generating element is a heat generating resistance member, and a thermal head is provided at said recording means, said thermal head comprising a plurality of such heat generating elements.

10. A recording apparatus according to claim 3, wherein said heat generating element is a heat generating resistance member, and a thermal head is provided at said recording means, said thermal head comprising a plurality of such heat generating elements.

11. A recording method according to claim 4, wherein said heat generating element is a heat generating resistance member, and a thermal head is provided at said recording means, said thermal head comprising a plurality of such heat generating elements.

12. A recording apparatus according to claim 5, wherein said heat generating element is a heat generating resistance member, and a thermal head is provided at said recording means, said thermal head comprising a plurality of such heat generating elements.

13. A recording method according to claim 7, wherein said heat generating element is a heat generating resistance member, and a thermal head is provided at said recording means, said thermal head comprising a plurality of such heat generating elements.

14. A recording apparatus according to claim 1, wherein said recording means has a thermal head and said thermal head has a plurality of heat generating elements.

15. A recording apparatus according to claim 1, wherein said recording means has an ink jet recording head for discharging ink through a discharge port thereof to record by utilizing thermal energy of said heat generating element.

16. A recording apparatus according to claim 1, wherein said recording means has an ink jet recording head for discharging an ink through a discharge port thereof to record by utilizing a bubble generated by thermal energy of said heat generating element.

17. A recording method according to claim 2, wherein said recording means has a thermal head and said thermal head has a plurality of heat generating elements.

18. A recording method according to claim 2, wherein said recording means has an ink jet recording head for discharging an ink through a discharge port thereof to record by utilizing thermal energy of said heat generating element.

19. A recording method according to claim 2, wherein said recording means has an ink jet recording head for discharging an ink through a discharge port thereof to record by utilizing a bubble generated by thermal energy of said heat generating element.

20. A recording apparatus according to claim 3, wherein said recording means has a thermal head and said thermal head has a plurality of heat generating elements.

21. A recording apparatus according to claim 3, wherein said recording means has an ink jet recording head for discharging an ink through a discharge port thereof to record by utilizing thermal energy of said heat generating element.

22. A recording apparatus according to claim 3, wherein said recording means has an ink jet recording head for discharging an ink through a discharge port thereof to record by utilizing a bubble generated by thermal energy of said heat generating element.

23. A recording method according to claim 4, wherein said recording means has a thermal head and said thermal head has a plurality of heat generating elements.

24. A recording method according to claim 4, wherein said recording means has an ink jet recording head for discharging an ink through a discharge port thereof to record by utilizing thermal energy of said heat generating element.

25. A recording method according to claim 4, wherein said recording means has an ink jet recording head for discharging an ink through a discharge port thereof to record by utilizing a bubble generated by thermal energy of said heat generating element.

26. A recording apparatus according to claim 25, wherein said recording means has a thermal head and said thermal head has a plurality of heat generating elements.

27. A recording apparatus according to claim 25, wherein said recording means has an ink jet recording head for discharging an ink through a discharge port thereof to record by utilizing thermal energy of said heat generating element.

28. A recording apparatus according to claim 25, wherein said recording means has a bubble jet recording head for discharging an ink through a discharge port thereof to record by utilizing a bubble generated by thermal energy of said heat generating element.

29. A recording method according to claim 7, wherein said recording means has a thermal head and said thermal head has a plurality of heat generating elements.

30. A recording method according to claim 7, wherein said recording means has an ink jet recording head for discharging an ink through a discharge port thereof to record by utilizing thermal energy of said heat generating element.

31. A recording method according to claim 7, wherein said recording means has an inkjet recording head for discharging an ink through a discharge port thereof to record by utilizing a bubble generated by thermal energy of said heat generating element.

32. A recording apparatus for recording on a recording medium, comprising:

head means for recording having a heat generating element;

voltage output means for outputting a drive voltage for driving said heat generating element so as to apply energy to said heat generating element to generate heat in response to a reference voltage;

accumulating means for accumulating a voltage amount of voltage in a predetermined time period to be supplied to said heat generating element as electric power during recording;

detecting means for detecting the voltage amount accumulated by said accumulating means; and control means for controlling the energy applied to said heat generating element by anticipating a temperature change in said head means in response to the voltage amount.

33. A recording apparatus according to claim 32, wherein said control means controls an output voltage from said voltage output means.

34. A recording apparatus according to claim 32, wherein said head means has a thermal head.

35. A recording apparatus according to claim 32, wherein said head means has an ink jet recording head for discharging ink through a discharge port thereof to record by utilizing thermal energy of said heat generating element.

36. A recording apparatus according to claim 32, wherein said head means has a bubble jet recording head for discharging an ink through a discharge port thereof to record by utilizing thermal energy of said heat generating element.

37. A recording apparatus in which a heat generating element at a recording means for recording generates heat and thereby effects image recording on a recording medium, said apparatus comprising:

setting means for setting a reference signal used in driving said heat generating element to generate heat;

driving signal outputting means for outputting a driving signal of said heat generating element based on said reference signal;

detecting means for detecting a signal corresponding to said driving signal supplied to said heat generating element during the image recording;

accumulating means for accumulating a value based on said signal detected by said detecting means in a predetermined time period; and control means for anticipating a temperature change of said recording means in accordance with said value and controlling said driving signal outputting means to adjust an energy to be applied to said heat generating element.

38. A recording apparatus according to claim 37, wherein each of said reference signal, said driving signal and said signal detected by said detecting means is a voltage signal.

39. A recording apparatus according to claim 37, wherein said apparatus further comprises ink discharging means having ink discharge ports for discharging an ink utilizing thermal energy generated by said heat generating element, to provide an ink jet recording apparatus.

40. A recording method in which a heat generating element at a recording means for recording generates heat and thereby effects image recording on a recording medium, said method comprising the steps of:

setting a reference signal to cause said heat generating element to generate heat;

detecting a signal corresponding to a driving signal supplied to said heat generating element during the image recording;

accumulating a value corresponding to said driving signal detected in said detecting step in a predetermined time period;

anticipating a temperature change of said recording means in accordance with said value accumulated in said accumulating step; and outputting said driving signal of said heat generating element in accordance with the temperature change anticipated in said anticipating step so as to control an energy to be applied to said heat generating element.

41. A recording method according to claim 40, wherein each of said reference signal, said driving signal and said signal detected in said detecting step is a voltage signal.

42. A recording method according to claim 40, wherein said method is an ink jet recording method, further comprising the step of discharging an ink utilizing thermal energy generated by said heat generating element.

43. A recording method using a heat generating element, said method comprising the steps of:

supplying a driving signal for driving said heat generating element to said heat generating element;

detecting a signal based on said driving signal;

accumulating a value based on said signal detected in said detecting step in a predetermined time period; and adjusting said driving signal in accordance with said value.

44. A recording method according to claim 43, wherein each of said driving signal and said signal detected in said detecting step is a voltage signal.

45. A recording method according to claim 43, wherein said method is an ink jet recording method, further comprising the step of discharging an ink utilizing thermal energy generated by said heat generating element.

* * * * *

UNITED STATES PATENT AND TRADEMARK OFFICE

CERTIFICATE OF CORRECTION

PATENT NO. : 5,633,671

DATED : May 27, 1997

INVENTOR(S) : YOUICHI WATANABE

It is certified that error appears in the above-identified patent and that said Letters Patent is hereby corrected as shown below:

COLUMN 2

Line 17, "of" should read --on--.
Line 33, "on" should read --of--.
Line 59, "sisal" should read --signal--.

COLUMN 4

Line 39, "#1-#4)." should read --#1-#64).--.

COLUMN 5

Line 42, "inputs" should read --its inputs--.
Line 54, "substracts" should read --subtracts--.
Line 55, "foreseen" should read --predicted--.

COLUMN 6

Line 13, "of" should be deleted.
Line 31, "0.1 Ψ." should read --0.1 Ω.--.
Line 56, "1.2 K Ψ." should read --1.2 K Ω.--.
Line 63, "100 K Ψ." should read --100 K Ω.--.

COLUMN 8

Line 25, "0.1 Ψ." should read --0.1 Ω.--.

UNITED STATES PATENT AND TRADEMARK OFFICE

CERTIFICATE OF CORRECTION

PATENT NO. : 5,633,671

DATED : May 27, 1997

INVENTOR(S) : YOUICHI WATANABE

It is certified that error appears in the above-identified patent and that said Letters Patent is hereby corrected as shown below:

COLUMN 9

Line 43, "0.1 Ψ - 0.3 Ψ." should read --0.1 Ω - 0.3 Ω--.

COLUMN 10

Line 13, "is" should be deleted.

COLUMN 12

Line 9, "said" should be deleted.
Line 28, "step and" should read --step; and--.
Line 49, "a value of" should be deleted.

COLUMN 14

Line 63, "claim 25," should read --claim 5,--.
Line 66, "claim 25," should read --claim 5,--.

COLUMN 15

Line 3, "claim 25," should read --claim 5,--.
Line 4, "a bubble" should read --an ink--.
Line 16, "inkjet" should read --ink jet--.

UNITED STATES PATENT AND TRADEMARK OFFICE

CERTIFICATE OF CORRECTION

PATENT NO. : 5,633,671

DATED : May 27, 1997

INVENTOR(S) : YOUICHI WATANABE

It is certified that error appears in the above-identified patent and that said Letters Patent is hereby corrected as shown below:

COLUMN 15, CONTINUED

Line 46, "ink" should read --an ink--.

Signed and Sealed this

Twenty-fourth Day of February, 1998

*Attest:*

Bruce Lehman

BRUCE LEHMAN

*Attesting Officer*

*Commissioner of Patents and Trademarks*